US006913140B2

(12) United States Patent
Lo Duca

(10) Patent No.: US 6,913,140 B2
(45) Date of Patent: Jul. 5, 2005

(54) BOX WITH POCKET OF HIGH STABILITY FOR ILLUSTRATIVE LEAFLET

(75) Inventor: Carmelo Lo Duca, Milan (IT)

(73) Assignee: GI.BI.EFFE S.r.l., Milan (IT)

( * ) Notice: Subject to any disclaimer, the term of this patent is extended or adjusted under 35 U.S.C. 154(b) by 14 days.

(21) Appl. No.: 10/602,650

(22) Filed: Jun. 25, 2003

(65) Prior Publication Data

US 2004/0011859 A1 Jan. 22, 2004

(30) Foreign Application Priority Data

Jul. 5, 2002 (IT) ..... MI2002A1488

(51) Int. Cl.[7] ..... B65D 69/00; B65D 75/00; B65D 25/04

(52) U.S. Cl. ..... 206/232; 206/784; 229/120.08; 229/120.13

(58) Field of Search ..... 206/232, 424, 206/784, 831, 775, 776; 229/120.02, 120.08, 120.13, 120.15, 120.18, 120.37; 40/312, 313

(56) References Cited

U.S. PATENT DOCUMENTS 3,147,856 A 9/1964 Lightner et al.
4,105,154 A * 8/1978 Meyers et al. ..... 229/120.18
4,125,185 A * 11/1978 Bliss ..... 206/775
5,513,752 A * 5/1996 Gottlieb ..... 206/232
6,702,108 B2 * 3/2004 Lo Duca ..... 206/232

FOREIGN PATENT DOCUMENTS

| | | |
|---|---|---|
| DE | 32 08 777 | 9/1983 |
| DE | 86 18 368 | 10/1986 |
| DE | 299 01 874 | 6/1999 |
| EP | 0 911 266 | 4/1999 |
| EP | 1 219 542 | 7/2002 |
| EP | 1 321 369 | 6/2003 |
| GB | 2 277 077 | 10/1994 |
| JP | 2000-296839 | 10/2000 |

* cited by examiner

*Primary Examiner*—Mickey Yu
*Assistant Examiner*—J. Gregory Pickett
(74) *Attorney, Agent, or Firm*—Oblon, Spivak, McClelland, Maier & Neustadt, P.C.

(57) ABSTRACT

A box formed from a single piece of cardboard and defining in its interior a highly stable pocket into which an illustrative leaflet can be inserted during the box manufacture.

3 Claims, 4 Drawing Sheets

BOX WITH POCKET OF HIGH STABILITY FOR ILLUSTRATIVE LEAFLET

FIELD OF THE INVENTION

The present invention relates to a box formed from a single piece of cardboard and defining in its interior a highly stable pocket into which, during the manufacture of the box, a leaflet can be inserted illustrating that product which is later to be inserted therein by the firm which uses the box.

BACKGROUND OF THE INVENTION

The term "illustrative leaflet" means any sheet, possibly folded several times on itself, carrying writing and instructions relative to the product contained in the box, or a card extractable from the pocket and having images or writing of any type reproduced on it.

Many products or articles are housed, preserved and transported in boxes or cases, normally of cardboard construction; very often, illustrative leaflets or the like are also inserted into these boxes. A frequent example is that in which the articles or products inserted into the boxes are containers of various kinds, bottles, or flat packs defining a plurality of recesses containing pharmaceutical products: in this latter case, the leaflets illustrating the pharmaceutical products must compulsorily be present in the actual boxes into which the bottles, containers or the like are inserted.

In the usual known art, the boxes are produced by specialist firms, whereas the pharmaceutical industry (or another box user) directly provides for inserting the bottles or the like together with the relative illustrative leaflets into them: this operation is relatively laborious and slow, especially as a result of the difficulties encountered in inserting the leaflet (often of large dimensions and folded over several times) into the box in such a manner that it still allows the bottle or pack to be freely inserted without the leaflet becoming creased.

To obviate these problems boxes have been proposed formed from a single piece of cardboard and defining in their interior a pocket into which the illustrative leaflet is inserted directly by the firms producing the boxes, the users of which have then merely to insert the articles (bottles or others) which the box is to contain.

Obviously, the pocket for the illustrative leaflet and the leaflet itself must be retained inside each box in a secure manner so that they do not interfere with the article inserted into the box by the box user or box preparer. Moreover the boxes must have a structure such that the illustrative leaflets can be inserted into them very simply and rapidly by the box manufacturer, directly while the boxes are being formed.

DESCRIPTION OF RELATED ART

GB-A-2277077 (see FIGS. 3 and 4) and DE-A-3208777 (see FIG. 2) describe boxes, into the interior of which there projects a freely rotatable flap which on one of its sides is rigid with one of the main side walls of the box, this flap facing a different main wall of the same box to form therewith a pocket housing the illustrative leaflet: these boxes cannot be used industrially because the flap which defines the pocket is connected to the box structure along only one of its sides, hence the flap can freely flex (or "open") towards the box interior, so preventing mechanical insertion thereinto of bottles or other packs of products to which the leaflet refers.

U.S. Pat. No. 3,147,856 (FIG. 3), EP-A-0911266 (FIG. 2) and DE 8618368U (FIG. 2) describe boxes similar to those of the two aforementioned patents, but in which the flap defining (with the box outer wall to which it is parallel and from which it is spaced) the pocket in the box interior has its free end folded at 90° about itself to form a tab (indicated by the reference numeral 42 in U.S. Pat. No. 3,147,856, by the numeral 16 in EP-A-0911266 and by the numeral 11 in DE 8618368U) which is glued to the adjacent main side wall of the box. These boxes present serious drawbacks, consisting of the fact that as the aforesaid flap has to be glued to the main wall during production of the boxes, which are despatched to the user firms as packs of identical boxes flattened against themselves, it becomes impossible to produce the boxes. To better understand this problem, it will be assumed that the boxes of FIG. 3 of U.S. Pat. No. 3,147,856 and FIG. 2 of EP-A-0911266 have to be flattened against themselves (as shown in FIG. 2 of U.S. Pat. No. 3,147,856) to be able to be stacked and despatched to the user. If the flaps 42 and 16 of the two boxes respectively are glued to the adjacent main surfaces of the boxes, it becomes impossible to flatten the boxes without damaging them; likewise the boxes cannot be brought from their flattened state to their shaped state, ready for inserting into them the products which they have to contain.

In contrast, if the flaps 42 and respectively 16 are not glued, the same drawbacks mentioned for the aforesaid already discussed patents arise.

DE 29901874U describes a box the end flap of which is folded towards the box interior and is glued onto another flap of the same box, also projecting towards the box interior, to hence define a pocket which enables an illustrative leaflet to be housed, but which prevents the user mechanically inserting into the shaped box the articles which it is intended to contain, because this is prevented by those flaps of the box which are glued together and project towards the box interior.

The application EP-A-1219542 in the name of the present Applicant, describes a box formed from several flaps or walls, two flaps or walls being folded into the box interior and being parallel to and adhering to corresponding outer walls of the box and being free, i.e. not fixed to the adjacent side walls of the box, to define a corner pocket housing an illustrative leaflet folded at a right angle to itself and positioned in correspondence with a longitudinal edge of the box, between two consecutive outer walls of the box and between the two flaps which are adjacent to them inside the box (see FIGS. 7 and 8 of EP-A-12129542). This embodiment presents the drawback that the free inner end flap of the box can easily flex towards the box interior, so interfering with the articles to be inserted into the finished box which contains the illustrative leaflet. EP-A-1321369 and the corresponding U.S. application Ser. No. 10/263,847 describe a box formed from a single piece of cardboard in which a profiled supplementary panel is provided projecting from one end of the main walls of the box and foldable into the box interior to define the pocket intended to contain the illustrative leaflet. After being produced by cardboard processing firms which prepare them with the illustrative leaflet already inserted therein, the boxes are compressed along two of their longitudinal edges to flatten them after which they are delivered to the firms using the boxes which shape them using automatic machines (so that their cross-section becomes square or rectangular, in general), and close the bottom panel or lid. To prevent the supplementary panel defining the pocket from withdrawing from the main wall of the box with which it forms the pocket, from a longitudinal side of said supplementary panel there projecting an appendix, the free end of which rests on the main wall opposite that on which the pocket is provided, to retain the supplementary panel securely within the pocket interior and prevent it from overturning (together with the illustrative leaflet) within the pocket, which would prevent automatic insertion into the box of the products or articles which it is intended to contain.

It has been found that the embodiment of the box described in the aforesaid Italian patent application is very efficient if the transformation or deformation of the box from its flattened state to its final shape (i.e. ready for insertion of the product) is effected with machines that act only in one direction, i.e. that rotate the box walls only in one direction. There exist however machines that firstly open the boxes out (starting from their flattened state), then they compress them to flatten them in the opposite direction to the original and then again open them out (this to eliminate or reduce the risk that the box automatically regains its flattened form after being "opened").

BRIEF SUMMARY OF THE INVENTION

The main object of the present invention is to provide a box formed from a single piece of cardboard and defining a pocket for housing an extractable leaflet or the like, in which the box is of very simple structure and especially in which said pocket is defined by an outer main panel of the box and by a supplementary panel which extends into the box and is prevented from turning within the box under any condition in which the box is used, by appendices projecting laterally from said supplementary panel.

These and other objects are attained by a box having the characteristics specified in the ensuing claims.

BRIEF DESCRIPTION OF THE SEVERAL VIEWS OF THE DRAWINGS

The structure and characteristics of the box will be more apparent from the ensuing description of one embodiment thereof given by way of non-limiting example with reference to the accompanying drawings, in which.

Figure 1:
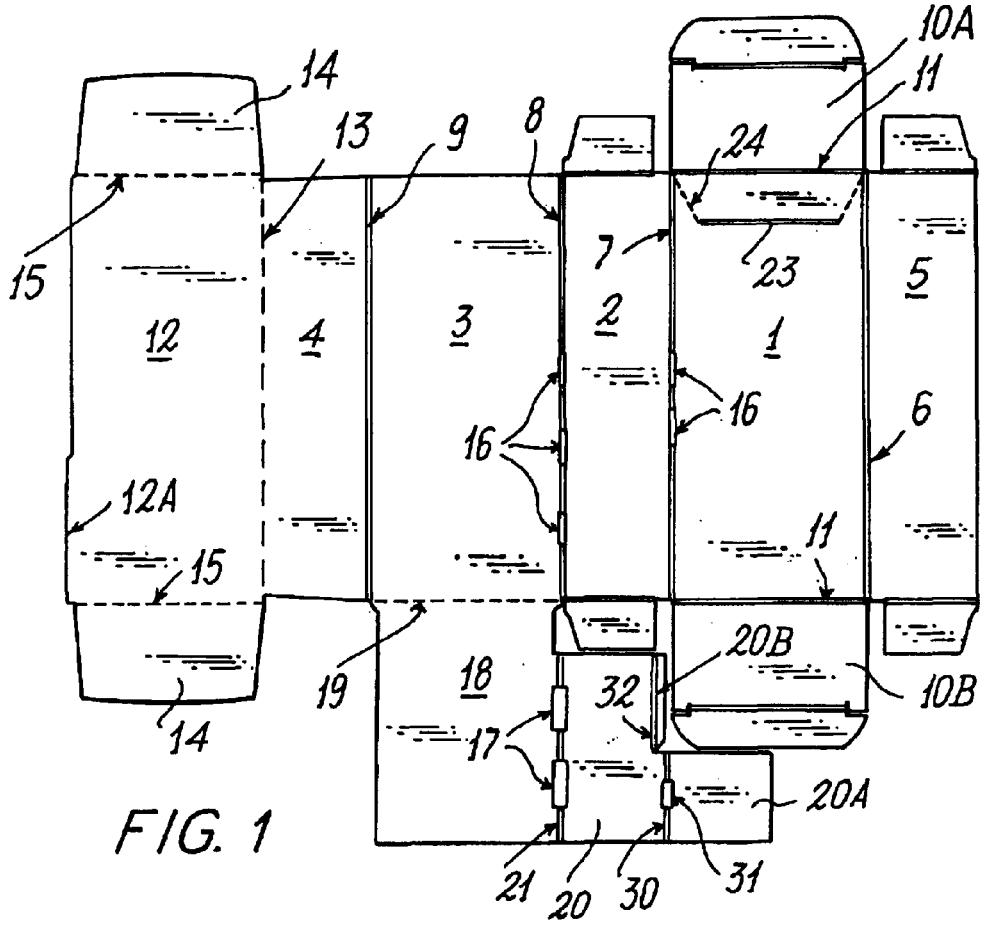
FIG. 1 is a plan view of a spread-out punched and crease-lined piece of cardboard usable for forming a box, the figure showing that surface of the cardboard sheet which is to remain on the inside of the box.
Figure 6:
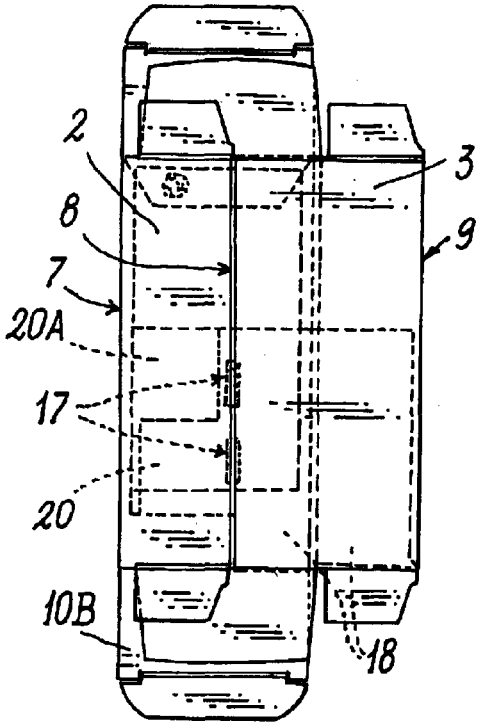
Figure 7:
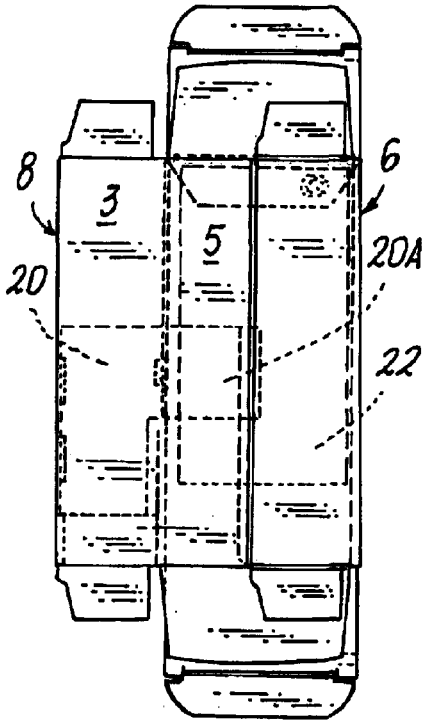
Figure 8:
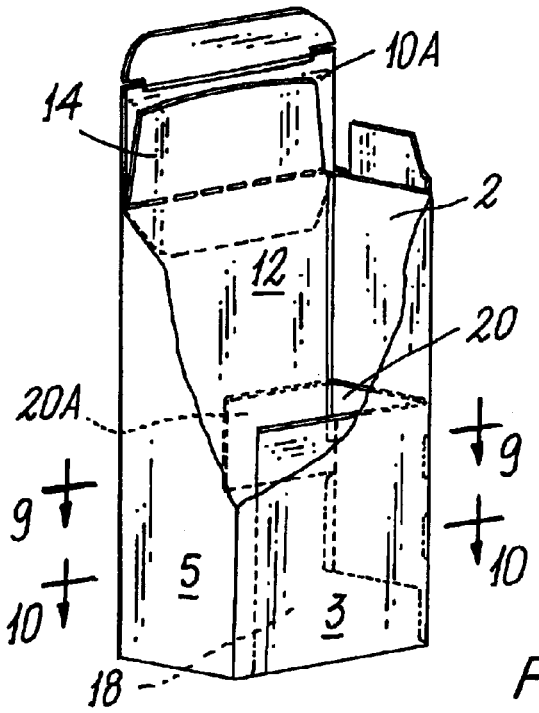
Figure 9:
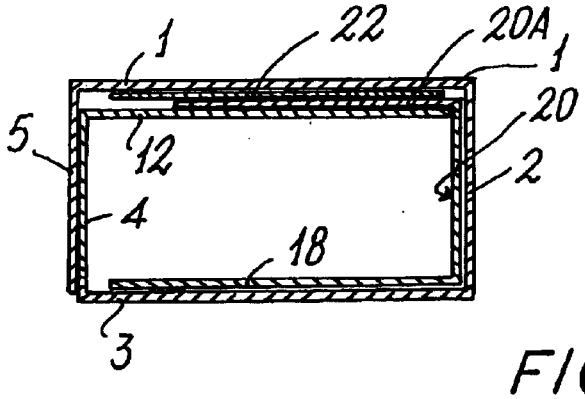
Figure 10:
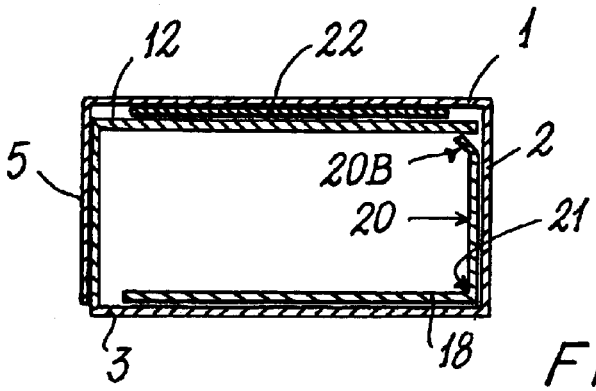

FIGS. from 2 to 5 show the piece of cardboard of FIG. 1 in its successive folding steps to form the box;

FIGS. 6 and 7 are front views of the box already finished by the firm which has produced and flattened or compressed it, in two different positions, according to the longitudinal crease lines about which the box panels have been rotated;

FIG. 8 is a perspective view of the finished box with its upper lid open, a portion of the box having been omitted to allow clearer vision of its interior;

FIGS. 9 and 10 are two cross-sections through the box on the lines 9—9 and 10—10 of FIG. 8.

DETAILED DESCRIPTION OF THE INVENTION

Reference will firstly be made to FIG. 1, which shows a spread-out piece of punched, crease-lined and knurled cardboard seen from its inner side, i.e. the opposite side to that on which the descriptive matter which has to be visible on the outside of the finished box is printed.

The cardboard sheet comprises four consecutive main panels 1–4 and a flap 5 projecting from the first of the main panels, i.e. the panel 1. The said panels and flap are separated one from another by longitudinal parallel crease lines or folding lines 6–9. From the two opposite ends of the main panel 1 there project two closure panels 10A and 10B (separated from the main panel by transverse crease lines or folding lines 11 perpendicular to the folding lines 6–9), intended to form the lid 10A (i.e. the top part) and respectively the bottom 10B of the box, whereas from opposing sides of the flap 5 and panel 2 there also project closure flaps, for simplicity not numbered.

From the last of the main panels, i.e. from the panel 4, there projects a supplementary panel 12 separated from the panel 4 by a knurled longitudinal folding line 13 parallel to the lines 6–9. From the upper and lower ends of the panel 12 there project two flaps 14 separated from it by knurled folding lines 15. From the drawings it can also be seen that the total width of the supplementary panel 12 is substantially equal to or slightly less than the width of the two main panels 1 and 3.

From the penultimate main panel, i.e. from the panel 3, there downwardly (with respect to FIG. 1) projects a supplementary panel 18 separated therefrom by a knurled folding line 19 transverse to the longitudinal folding lines 6–9 and 13, from said supplementary panel 18 there projecting (towards the first main panel 1, i.e. towards the right in FIG. 1) a flap 20 separated therefrom by a folding line 21 which is also longitudinal.

It can be seen from the drawings that in the panel 1 there are provided both a transverse crease line or folding line 23 (shorter than the two crease lines 11 and positioned between them) and a pair of tearable knurlings 24 which extend between the ends of the upper (with respect to the drawing) crease line 11 and the crease line 23, to define a portion 1A of the main panel 1.

The structure of the box described up to this point is known and is illustrated in the already cited EP-A-321369; the box of the present invention differs therefrom by the fact that short cuts 16 are made in correspondence with the crease lines 7 and 8; that other cuts 17 are made in correspondence with the crease line 21; that the supplementary panel 12 presents a short projection 12A in correspondence with its lower (with respect to FIG. 1) free edge; that from the flap 20 there projects a supplementary tab 20A separated from the flap 20 by a crease line 30 in which a short cut 31 is made; and that in the upper part (with respect to FIG. 1) of the flap 20 there is provided a crease line 32 which defines a narrow long portion 20B of the flap 20.

The presence of the cuts 16, 17 and 31 is very important to enable subsequent easy folding of the cardboard sheet during the preparation of the box and its subsequent pressing and straightening by the box user. The flap 20 is essential to prevent the supplementary panel 18 which defines the pocket from flexing or oscillating towards the box interior, while the tab 20B and the projection 12A of the panel 12 contribute greatly to maintaining the finished box in its open state.

It will now be assumed that the cardboard processing firm which has produced the punched and crease-lined cardboard sheet of FIG. 1 then folds it in order to form from it the box to be despatched to the box user.

Figure 2:
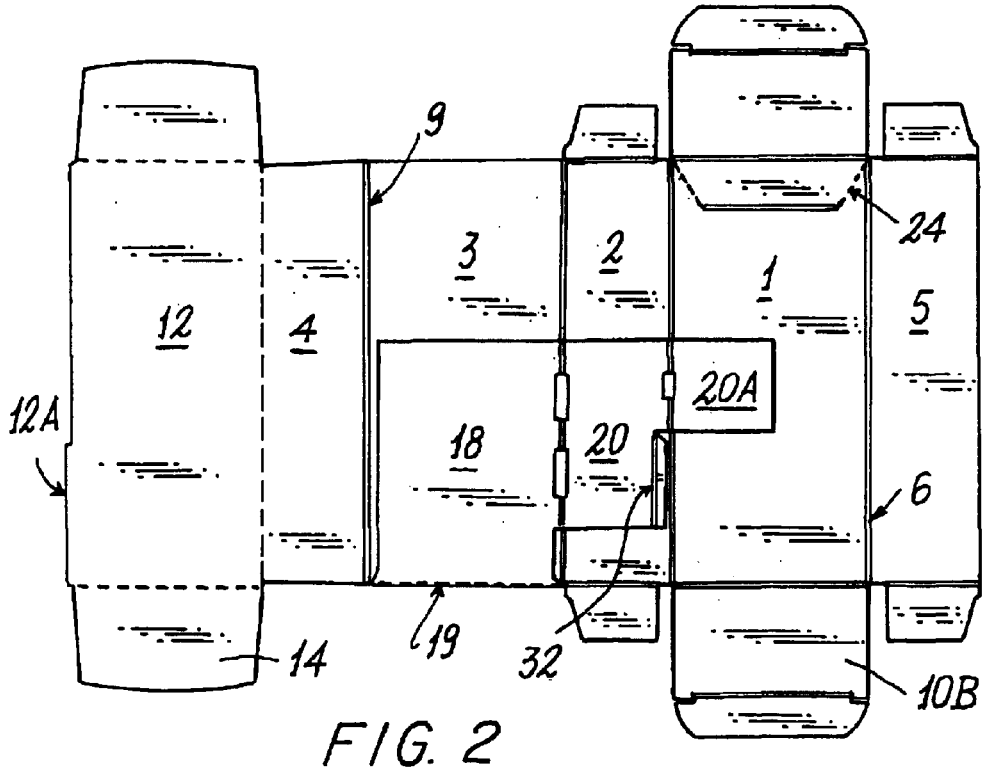
Figure 3:
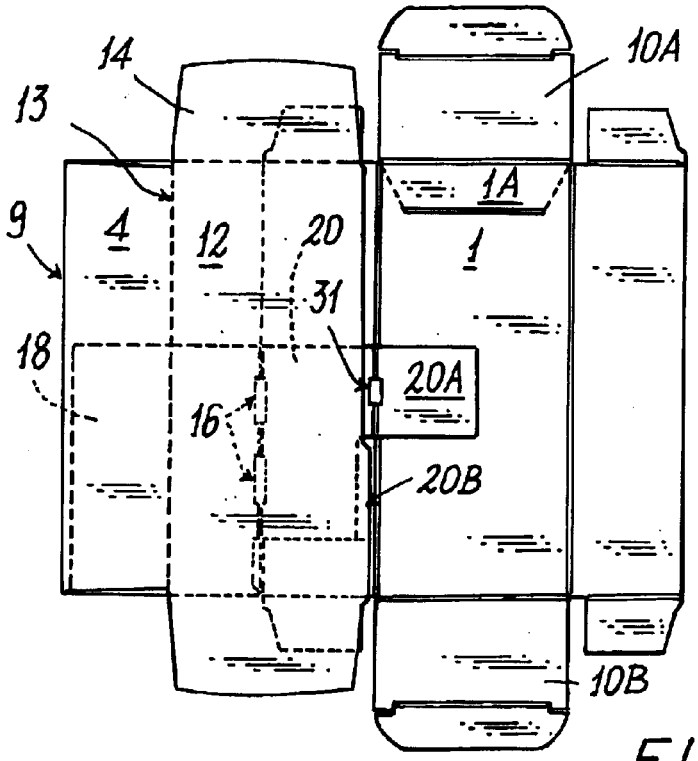
Figure 4:
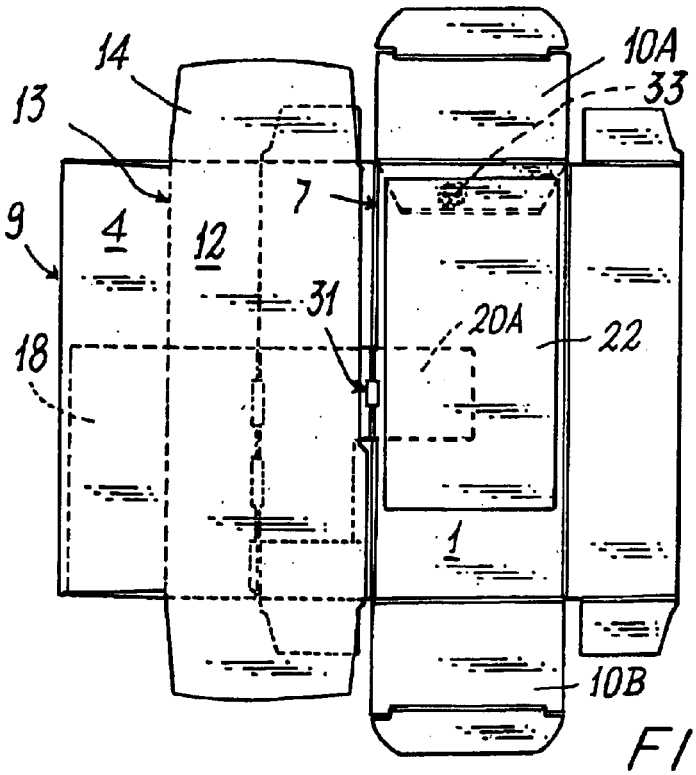
Figure 5:
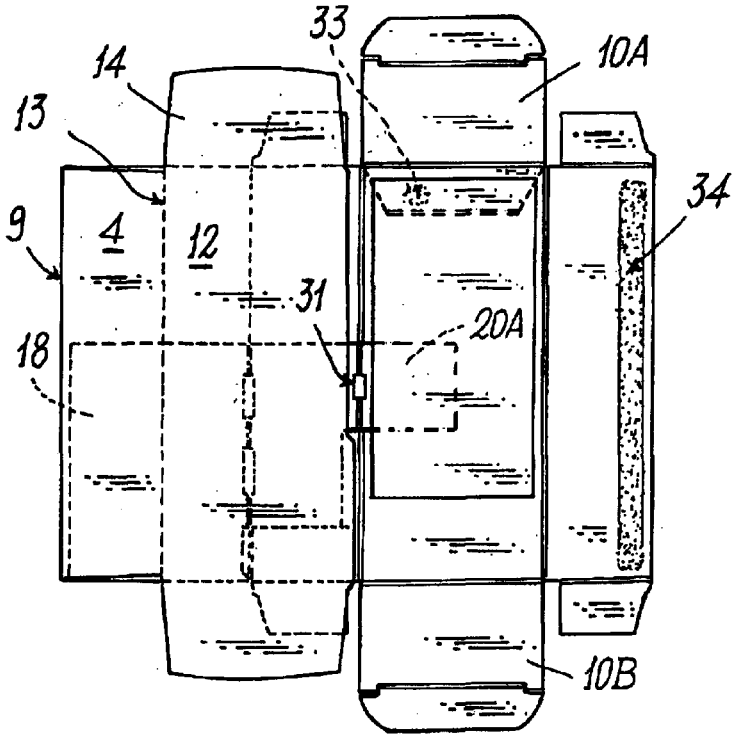

In a first step, the supplementary panel 18 together with the tabs 20A, 20B are folded (by rotating them about the knurled folding line 19) onto the penultimate main panel 3 and, respectively, onto the main panels 2 and 1, as shown in FIG. 2. The main panel 4 together with the end panel 12 are then folded about the folding line 9 onto the supplementary panel 18 and flap 20 (FIG. 3), after which an illustrative leaflet 22—previously printed and possibly folded on itself—is (always automatically) rested on the upwardly facing surface of the panel 1 and tab 20A, removably securing the leaflet 22 to the panel 1 by a spot of low-tenacity glue 33 (FIG. 4); one or more strips of glue 34 are then applied to the panel 5 (FIG. 5).

Finally the group of panels 2–5 (together with the panel 18 and the flap 20 interposed between them) is folded about the folding line 7, gluing the panel 5 onto the panel 4 (FIG. 6).

Under these conditions the leaflet 22 is housed and retained in a pocket defined on one side by the end panel 12 and on the other side by the main panel 1 on which the tab 20A is superposed.

The compressed and flattened box of FIG. 6 can be easily brought into the state shown in FIG. 7 by rotating the various walls of the box through 180° about the respective longitudinal crease lines, to cause it to assume the flattened position shown in FIG. 7. The reason for this is that certain user firms wish to receive boxes flattened in a specific one or the other of the two states of FIGS. 6 and 7.

It is important to determine that on termination of this overturning of the box between the two flattened positions of FIGS. 6 and 7, the cavity in the box interior always remains absolutely free, so that no obstacle exists to the insertion of any article into the finished box by the firm using the finished box.

In this respect, as is apparent from FIGS. 8, 9 and 10, the panel 18 cannot flex towards the interior of the box because it is connected to it in correspondence with the crease lines 19 and 21; the flap 20 cannot flex because it is retained by its tab 20A which is locked between the walls 1 and 12 of the box (FIG. 9); and the box wall 12 cannot flex inwards because this is prevented by the edge 20B of the flap 20 (FIG. 10). In this manner, the pocket in which the illustrative leaflet 22 is inserted has and maintains a stable attitude, both during the pressing of the flattened box between the two positions of FIGS. 6 and 7, and during the use of the box.

The projection 12A on the panel 12 acts as a support for the lower (with respect to the figures) edge of the tab 20A, ensuring that it maintains its correct position in the finished box.

When the leaflet 22 is to be extracted from the box, the lid 10A is opened, folded outwards and pulled until the knurlings 24 tear, so making the leaflet visible and easily grippable by two fingers to extract it from the pocket of the box.

The flap 14 projecting from the upper end of the box acts as a chute to facilitate the insertion of any product into the box when both the lid 10A and the flap 14 are rotated outwards from the box (FIG. 8), so preventing the product interfering with the illustrative leaflet or with those walls of the box which define the pocket.

If required, one or more holes can be provided through the wall 12, through which the presence of the illustrative leaflet in the pocket can be verified, or part of the leaflet be read.

I claim:

1. A box formed from a single piece of punched and crease-lined cardboard, defining an internal pocket for containing an extractable leaflet, comprising:

at least four consecutive main panels, a first flap which projects from the first main panel and is superposed on and glued to the last main panel in the finished box, an end panel which projects from the last main panel and has a width substantially equal to that of the first main panel, which it faces in the box interior to form with said first panel a pocket for containing said leaflet, at least one panel for closing at least one end of the box, the main panels, the end panel and said first flap being separated one from another other by parallel longitudinal folding lines, in which from the penultimate main panel there projects a supplementary panel separated from it by a folding line transverse to said longitudinal folding lines, from said supplementary panel there projecting a second flap separated from it by a likewise longitudinal folding line, the supplementary panel and the second flap projecting from it being folded into the box interior about their folding lines such that the supplementary panel and, respectively, said second flap are superposed on the penultimate main panel and respectively on that main panel adjacent to it on the side towards the first panel, the main panels and also the end panel being folded about their longitudinal folding lines such that the end panel becomes superposed on the first main panel in the box interior to form therewith said pocket, while the free longitudinal edge of the end panel rests on the second flap of the supplementary panel, wherein from said second flap there projects a supplementary tab separated from said second flap by a longitudinal folding line in which at least one cut is provided, cuts also being provided in the longitudinal folding lines which separate the main panels from each other, the width of the supplementary tab being substantially equal to the width of the main panel aligned with it, the tab being inserted into the pocket in which the leaflet is housed, wherein said supplementary tab projects only from a limited length of the second flan in proximity to its free end, from the remaining length of said second flan there projecting a narrow appendix on which there rests the free edge of the end panel defining the pocket for the leaflet, to prevent said panel from flexing towards the box interior.

2. A box as claimed in claim 1, wherein from the free edge of the end panel defining the pocket for the leaflet there projects an appendix which acts as a support for said second flap and tab.

3. A sheet in the form of a single piece of punched and crease-lined cardboard for forming a box as defined in claims 1 or 2.

* * * * *